US006828948B2

(12) United States Patent
Volman et al.

(10) Patent No.: US 6,828,948 B2
(45) Date of Patent: Dec. 7, 2004

(54) BROADBAND STARFISH ANTENNA AND ARRAY THEREOF

(75) Inventors: Vladimir Volman, Newtown, PA (US); Eric Talley, Hamilton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 153 days.

(21) Appl. No.: 10/284,267

(22) Filed: Oct. 31, 2002

(65) Prior Publication Data

US 2004/0032378 A1 Feb. 19, 2004

Related U.S. Application Data

(60) Provisional application No. 60/330,834, filed on Oct. 31, 2001.

(51) Int. Cl.[7] ..... H01Q 1/36

(52) U.S. Cl. ..... 343/897; 343/742; 343/867; 343/846

(58) Field of Search ..... 343/700 MS, 741, 343/742, 866, 867, 795, 846, 848, 897

(56) References Cited

U.S. PATENT DOCUMENTS 5,293,176 A * 3/1994 Elliot ..... 343/797
5,646,633 A * 7/1997 Dahlberg ..... 343/700 MS
6,014,107 A * 1/2000 Wiesenfarth ..... 343/742
6,329,955 B1 * 12/2001 McLean et al. ..... 343/742
6,452,549 B1 * 9/2002 Lo ..... 343/700 MS

OTHER PUBLICATIONS

H. Nakano et al., "Mesh Antennas for Dual Polarization," IEEE Transactions on Antennas and Propagation; pp. 715–723; vol. 49, No. 5; May 2001.

* cited by examiner

*Primary Examiner*—Tan Ho
(74) *Attorney, Agent, or Firm*—McDermott Will & Emery LLP

(57) ABSTRACT

A broadband mesh antenna and a phased array broadband mesh antenna are provided. The antenna of the present invention is a mesh antenna system that may be implemented with printed circuit board technology and wired technology that operates with increased bandwidth. The mesh antenna system provides for a single mesh antenna to operate at a wide range of frequencies. The antenna may be employed as a high efficient broadband antenna for rockets, space vehicles and ships when placed inside a metallic open box.

70 Claims, 16 Drawing Sheets

Prior Art

BROADBAND STARFISH ANTENNA AND ARRAY THEREOF

CROSS REFERENCE TO RELATED PATENT APPLICATIONS

This application is based on, and claims the benefit of, provisional application 60/330,834 filed Oct. 31, 2001.

BACKGROUND OF THE INVENTION

1. Field of the Invention

The present invention relates to antenna systems. More particularly, the present invention relates to a starfish mesh antenna and array thereof with increase bandwidth implemented with printed circuit board technology.

2. Description of the Prior Art

Generally, patch antenna systems are implemented with printed circuit board technology. Patch antenna systems are typically one-resonance antenna systems, and thus, operate within a limited bandwidth, such as up to ten percent. Accordingly, patch antenna systems are typically designed to operate within a specific frequency band. These types of antenna systems typically require that an individual or single patch antenna is provided to operate at each frequency.

A prior art narrow-band mesh antenna as an extension of the loop antenna published in "IEEE Transactions on Antenna and Propagation", vol. AP-49, pp. 715–723, May 2001 is illustrated in FIG. 1*a*. The authors wrote in the abstract: " . . . [t]he frequency bandwidth for VSWR=2 criterion is evaluated to be approximately 3% . . . [t]he frequency bandwidth for a 3 dB axial ratio criterion is calculated to be approximately 1%." The feeding points a,b,c, and d are connected to coax.

There is a need for a mesh antenna system implemented with printed circuit board technology. There is a need for a mesh antenna system that operates at a bandwidth of more than one octave. There is a need for a mesh antenna system that is low cost. There is a need for a mesh antenna system that can be implemented for use with satellites, radars, space-vehicles and aircrafts.

SUMMARY OF THE INVENTION

According to embodiments of the present invention, a broadband mesh antenna and a phased array broadband mesh antenna are provided. The antennas of the present invention are mesh antenna systems implemented with printed circuit board technology that operates with increased bandwidth more than one octave. The simulated data presented in the disclosure of the present invention, illustrates a single mesh antenna operable at a wide range of frequencies, such as between 250 MHz to 730 MHz. The mesh antenna can be scaled to other frequency bands employing a 2.92:1 coverage ratio.

According to an embodiment of the present invention, a broadband mesh antenna includes an element including a conductive surface. The conductive surface includes a) a symmetrically shaped conductive surface, such as a square loop, around a point corresponding to the center of the symmetrically shaped conductive surface, b) a first set of linear conductive surfaces extending away from the point corresponding to the center of the symmetrically shaped conductive surface, and c) a second set of linear conductive surfaces. Each linear conductive surface in the second set of linear conductive surfaces extends away from a point on a linear conductive surface in the first set of linear conductive surfaces to a corner of the symmetrically shaped conductive surface. The first set of linear conductive surfaces and second set of linear conductive surfaces enables the broadband mesh antenna to operate at a set of octaves.

According to an embodiment of the present invention, the broadband mesh antenna further includes a set of feed ports, such as four, symmetrically located around the point corresponding to the center of the symmetrically shaped conductive surface. A ground screen couples to the set of feed ports employing a corresponding set of feed lines, such as four coaxial lines. The ground screen is a distance h away from the element. The broadband mesh antenna can be provided within an box with an open top manufactured from structures such as wires and metal. The excitation of the broadband mesh antenna can be provided by coupling an inner conductor of each feed line to a feed port and coupling the outer conductors of each feed lines to the ground screen.

According to an embodiment of the present invention, a broadband mesh antenna includes an element including a conductive surface. The conductive surface includes a) a first symmetrically shaped conductive surface, such as a square loop, around a point corresponding to the center of the symmetrically shaped conductive surface, b) a first set of linear conductive surfaces extending away from the point corresponding to the center of the symmetrically shaped conductive surface, and c) a second symmetrically shaped conductive surface, such as a starfish, around a point corresponding to the center of the symmetrically shaped conductive surface. The first and second symmetrically shaped conductive surfaces enables the broadband mesh antenna operates at a first set of octaves.

According to an embodiment of the present invention, a broadband phased array mesh antenna includes a set of elements, each element in the set of elements including a conductive surface. Each conductive surface includes a) a symmetrically shaped conductive surface, such as a square loop, around a point corresponding to the center of the symmetrically shaped conductive surface, b) a first set of linear conductive surfaces extending away from the point corresponding to the center of the symmetrically shaped conductive surface, and c) a second set of linear conductive surfaces. Each linear conductive surface in the second set of linear conductive surfaces extends away from a point on a linear conductive surface in the first set of linear conductive surfaces to a corner of the symmetrically shaped conductive surface. The first set of linear conductive surfaces and second set of linear conductive surfaces enables the broadband mesh antenna to operate at a set of octaves.

According to an embodiment of the present invention, the broadband mesh antenna further includes each antenna element includes a set of feed ports, such as four, symmetrically located around the point corresponding to the center of the symmetrically shaped conductive surface. A ground screen couples to the set of feed ports employing a corresponding set of feed lines, such as four coaxial lines. The ground screen is a distance h away from the element. The broadband mesh antenna can be provided within an box with an open top manufactured from structures such as wires and metal.

According to an embodiment of the present invention, a phased broadband mesh array antenna includes a set of elements, each element in the set of elements including a conductive surface. Each conductive surface includes a) a first symmetrically shaped conductive surface, such as a square loop, around a point corresponding to the center of the symmetrically shaped conductive surface, b) a first set of linear conductive surfaces extending away from the point corresponding to the center of the symmetrically shaped conductive surface, and c) a second symmetrically shaped conductive surface, such as a starfish, around a point corresponding to the center of the symmetrically shaped conductive surface.

DETAILED DESCRIPTION OF THE INVENTION

The present invention is now described more fully hereinafter with reference to the accompanying drawings that show a preferred embodiment of the present invention. The present invention, however, may be embodied in many different forms and should not be construed as limited to embodiments set forth herein. Appropriately, embodiments are provided so that this disclosure will be thorough, complete and fully convey the scope of the present invention.

According to embodiments of the present invention, a broadband mesh antenna and a phased array broadband mesh antenna are provided. The antenna of the present invention is a mesh antenna system that may be implemented with printed circuit board technology and wired technology. The mesh antenna system operates with an increased bandwidth of more than one octave, whereas prior art patch and mesh antenna operates with bandwidth of about 3%–10% only. The mesh antenna of the present invention provides for a single mesh antenna to operate at a wide range of frequencies, such as between 250 MHz to 730 MHz or any other frequency band by scaling the antenna sizes with the same 2.92:1 frequency coverage. The antenna may be employed as a high efficient broadband antenna for rockets, and space vehicles or other applications when placed inside a metallic open box, such as aluminum.

Figure 1A:
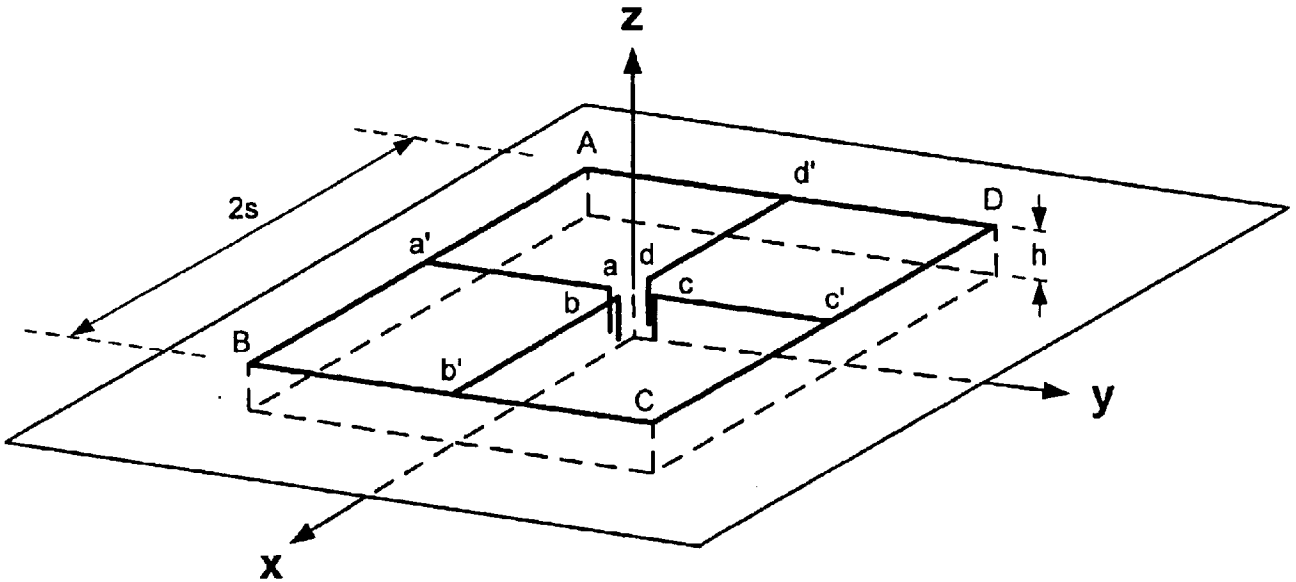
FIG. 1*a* depict a prior art patch antenna.
Figure 1B:
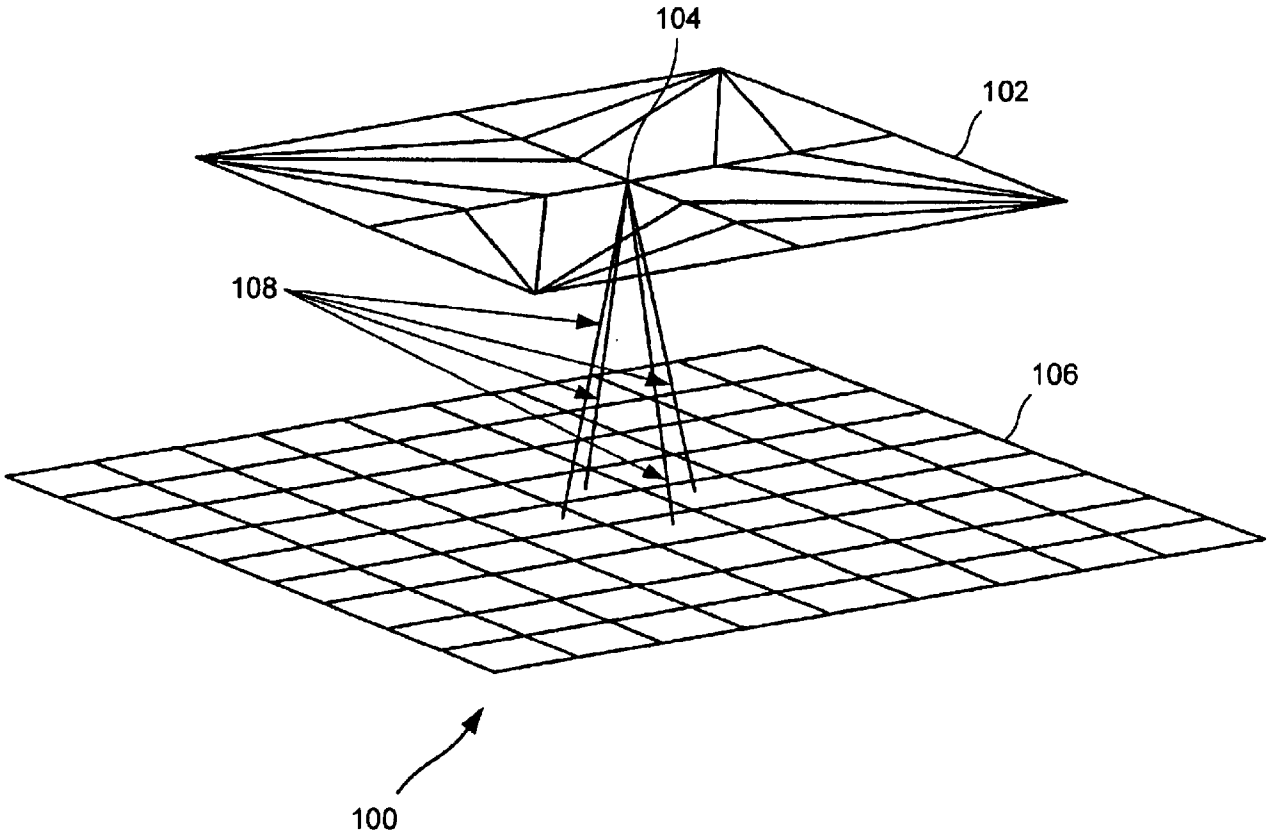
FIG. 1*b* depicts an exemplary side view of Ultra Broadband Mesh Antenna according to an embodiment of the present invention.

An exemplary side view of Ultra Broadband Mesh Antenna according to an embodiment of the present invention is shown in FIG. 1*b*. In the FIG. 1*b* embodiment of the present invention, the Ultra Broadband Mesh Antenna 100 includes an antenna element 102, feed ports 104, a ground plane 106 and 4 feed lines 108. Antenna element 102 may be provided as a conductive surface. The conductive surface includes, but is not limited to, wired technology. Antenna element 102 radiates electromagnetic waves, and includes feed ports 104 located symmetrically around the center of antenna element 102. Feed ports 104 are operable to connect antenna element 102 to a receiver (not shown) or transmitter (not shown).

Feed lines 108 couple to feed ports 104 and ground plane 106. Feed lines 108 transmit and receive information to and from Ultra Broadband Mesh Antenna. The ground plane 106 may include a screen or a bottom of an open top metallic box. Ground plane 106 includes holes or slots for feed lines 108. The ground plane prevents the reception and/or transmission of electromagnetic radiation from or to the antenna element. Ultra Broadband Mesh antenna 100 may be considered as a superposition of set of electrical and magnetic dipoles connected in parallel to the ports. In the FIG. 1*b* embodiment, the input impedance should keep almost stable for octaves of one and more with some variation around $60\pi \cong 188$ Ohms.

Figure 2A:
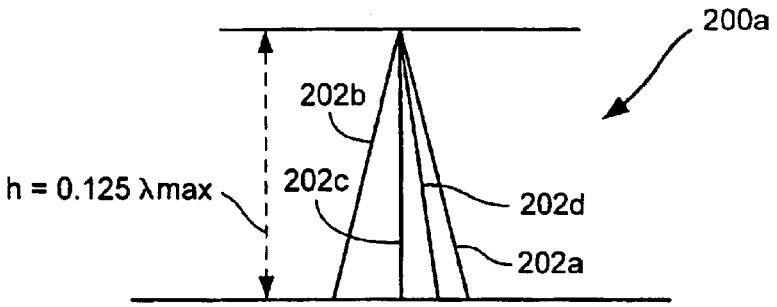
FIG. 2*a* depicts an exemplary side view of feed coaxial lines according to an embodiment of the present invention.

An exemplary side view of a broadband mesh antenna according to an embodiment of the present invention is shown in FIG. 2*a*. In the FIG. 2*a* embodiment of the present invention, feed lines 200*a* include a set of four feed lines 202*a*–202*d*. The feed lines may be, but are not limited to, coaxial lines, waveguides, microstrip lines, and coplane lines. Each of the feed lines 202 includes a first free end, a second free, inner conductors and outer conductors. The inner conductors of the first free end of each feed line couples to a feed port of antenna element 102 shown in FIG. 1*b*. The outer conductor of the second free end of each feed line couples to ground element 106 shown in FIG. 1*b*. The broadband mesh antenna may be excited by employing the connection of the feed lines in the manner mentioned above. In the FIG. 2*a* embodiment of the present invention, the height (h) between antenna element 102 and ground element 106 is $h=0.125\ \lambda_{max}$ when the coaxial lines are coupled to an antenna element 102 and ground element 106, where $\lambda_{max}$ is the wavelength for the lowest band frequency.

Figure 2B:
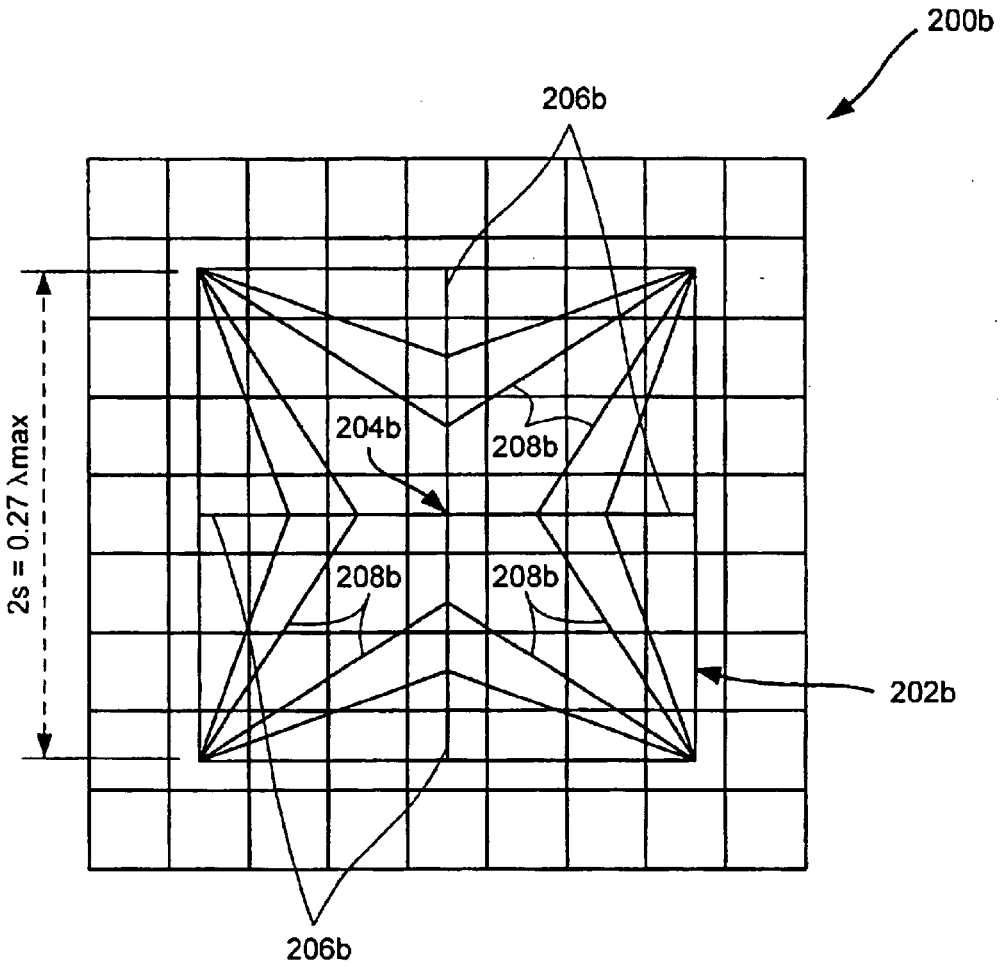
FIG. 2*b* depicts an exemplary top view of a starfish antenna pattern diagram for the Ultra Broadband Mesh Antenna illustrated in FIG. 1*b* according to an embodiment of the present invention.

An exemplary top view of an antenna element illustrated in the Broadband Mesh Antenna illustrated in FIG. 1*b* is shown in FIG. 2*b*. In the FIG. 2*b* embodiment of the present invention, antenna element 200*b* is provided with symmetrically shaped configurations including a starfish and square. The antenna element 200*b* may be a conductive surface including wire technology and printed circuit board technology. In the FIG. 2*b* embodiment, a first symmetrically shaped conductive surface 202*b*, such as a square, is formed around a point 204*b* corresponding to the center of the first symmetrically shaped conductive surface 202*b*. A first set of linear conductive surfaces 206*b* extend away from point 204*b* to the midpoints of the sides of the first symmetrically shaped conductive surface. The first set of linear conductive surfaces form right angles with respect to one another.

In the FIG. 2*b* embodiment of the present invention, a second symmetrically shaped conductive surface 200*b*, such as a starfish, may be formed by providing a second set of linear conductive surfaces 208*b*. The second set of linear conductive surfaces 208*b* extend away from points on the first set of linear conductive surfaces 206*b* to a corner of the first symmetrically shaped conductive surface 202*b* nearest the point on the first set of linear conductive surfaces. A plurality of starfish configurations may be formed by providing a second set of linear conductive surfaces 208*b* that extend away from points on the first set of linear conductive surfaces 206*b* to a corner of the first symmetrically shaped conductive surface 202*b* nearest the point on the first set of linear conductive surfaces. In the FIG. 2*b* embodiment of the present invention, each side of the symmetrically shaped conductive surface 202*b* is 2s=0.27 λ, where $\lambda_{max}$ is the wavelength for the lowest band frequency.

Figure 3A:
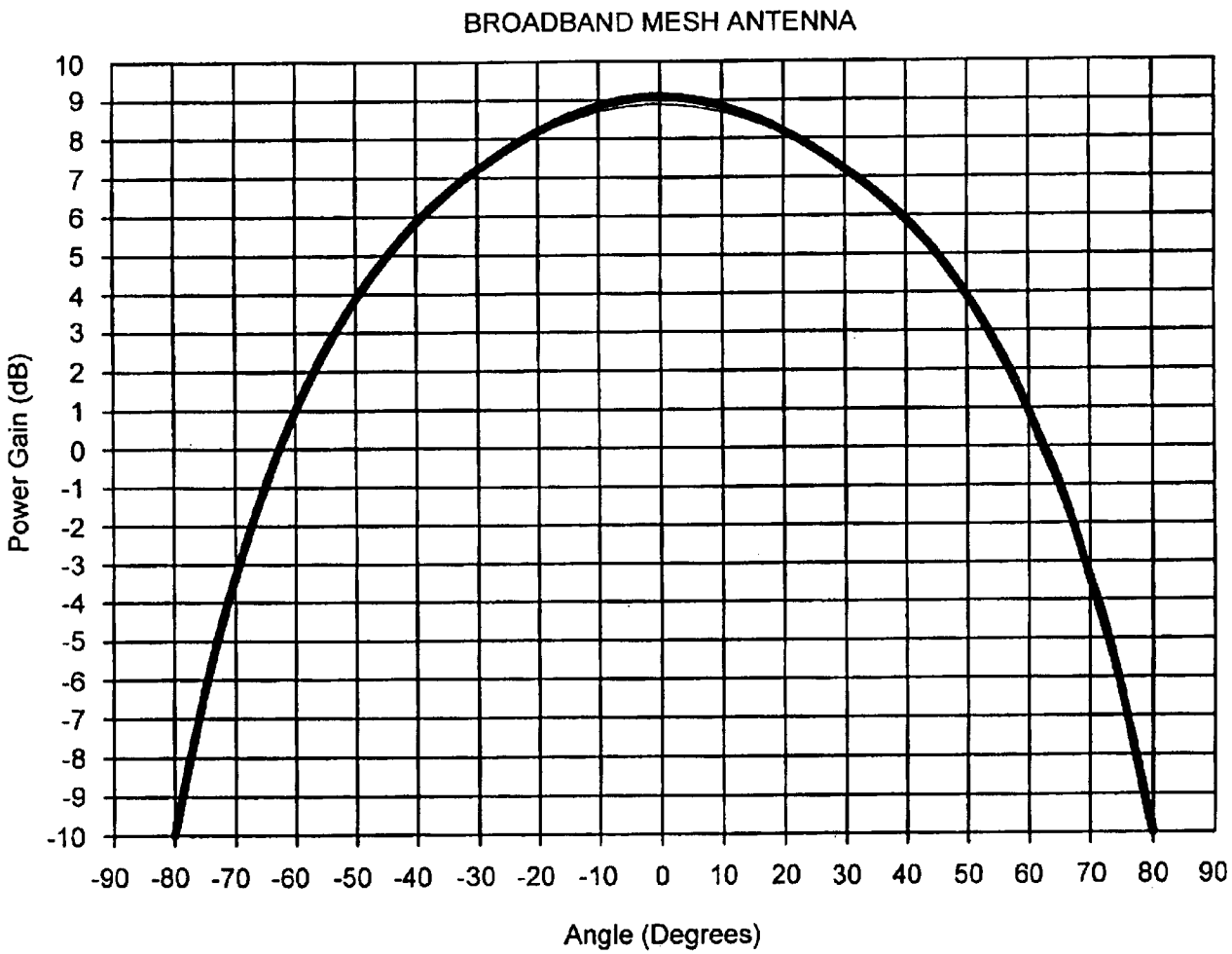
FIGS. 3*a*–3*b* illustrate directivity plots for the Ultra Broadband Mesh Antenna illustrated in FIG. 1*b* according to an embodiment of the invention.
Figure 3B:
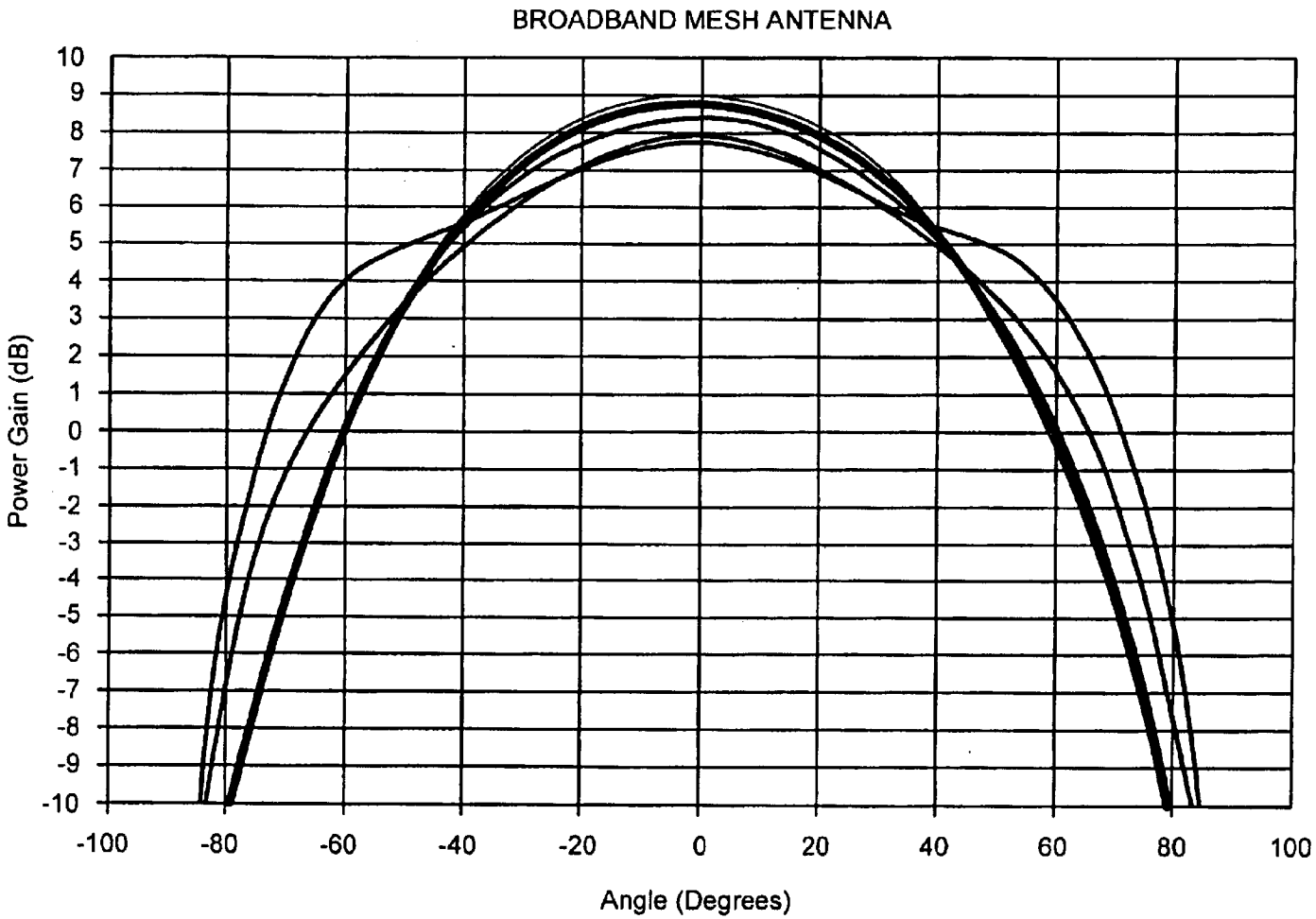

Pattern diagrams for frequency bands from 250 MHz to 730 MHz are shown in FIGS. 3*a*–3*b* according to an embodiment of the present invention for the Ultra Broadband Mesh Antenna illustrated in FIG. 1*b*. In the graph of FIG. 3*a*, the peak directivity is 92–8.8 dB for frequency bands from 250 MHz to 490 MHz. In the graph of FIG. 3*b*, the peak directivity is 8.8–7.8 dB for frequency bands from 490 MHz to 730 MHz.

Figure 4A:
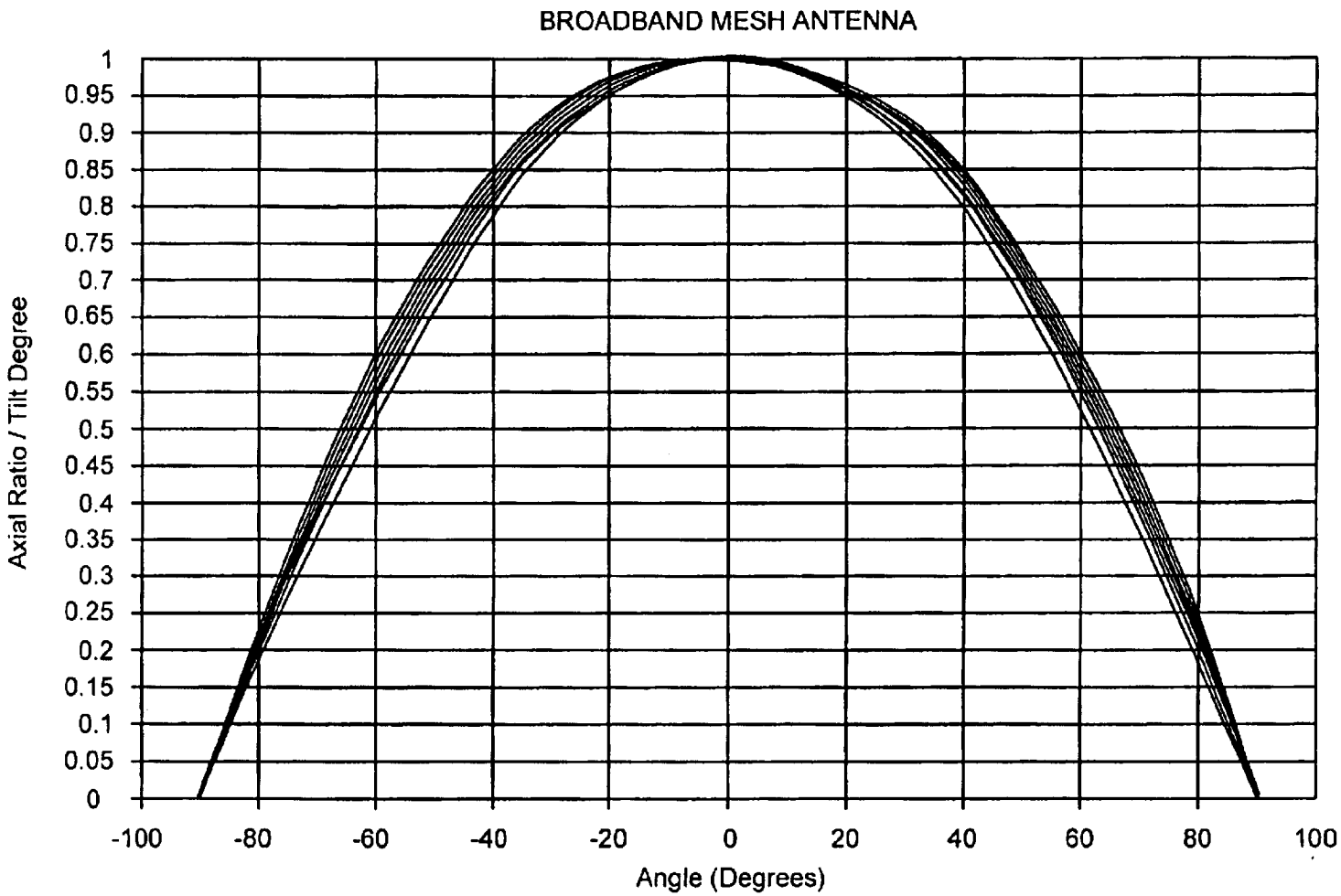
FIGS. 4*a*–4*b* illustrate Axial Ratios for the Ultra Broadband Mesh Antenna illustrated in FIG. 1*b* according to an embodiment of the present invention.
Figure 4B:
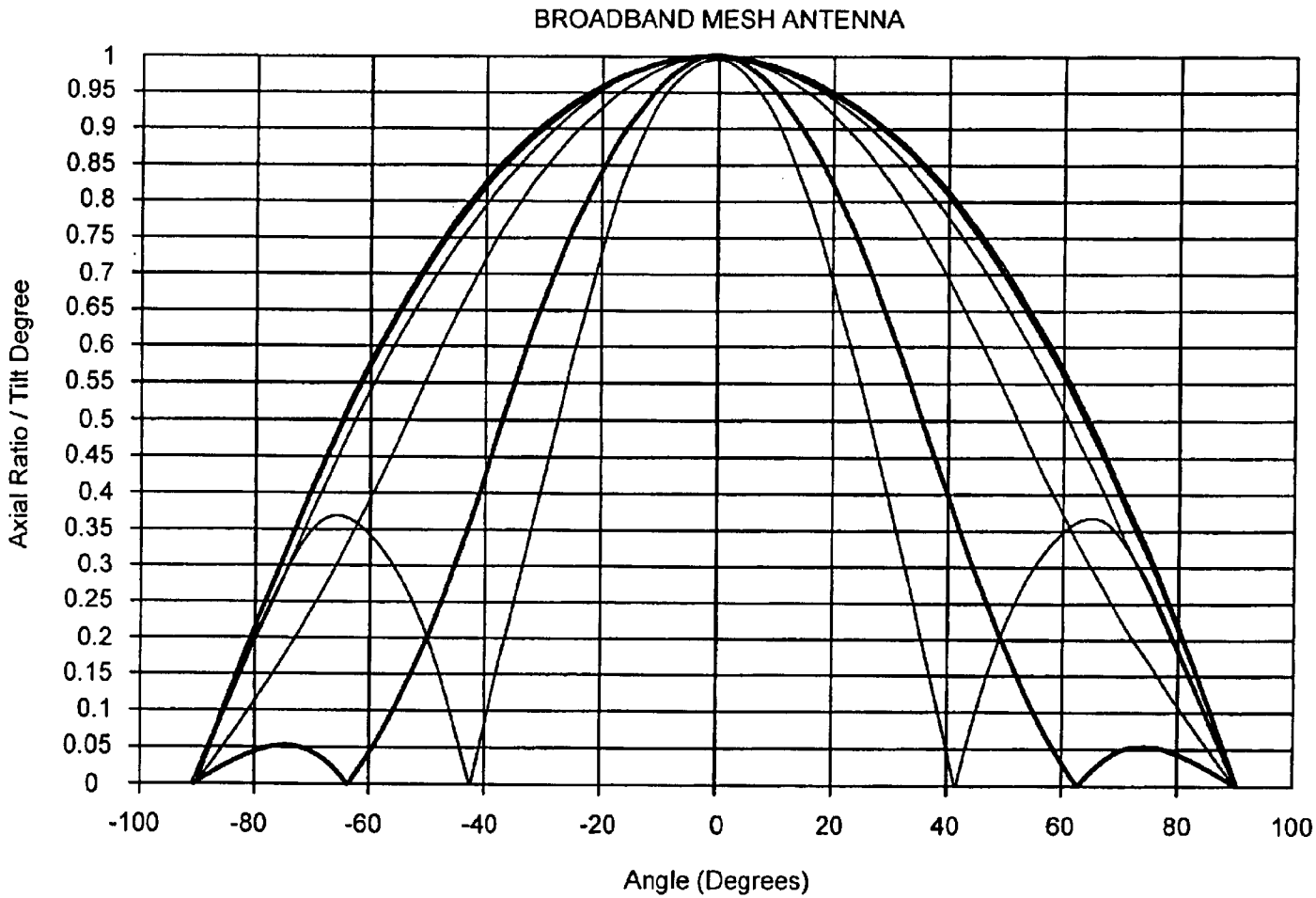

Axial Ratio for frequency bands from 250 MHz to 730 MHz are shown in FIGS. 4*a*–4*b* according to an embodiment of the present invention for the Ultra Broadband Mesh Antenna illustrated in FIG. 1*b*. In the graph of FIG. 4*a*, the axial ratio inside sector ±20° is less than 0.5 dB for frequency bands from 250 MHz to 640 MHz. In the graph of FIG. 4*b*, the axial ratio inside the sector ±20° increases and is less than 3 dB for frequency 730 MHz.

Figure 5A:
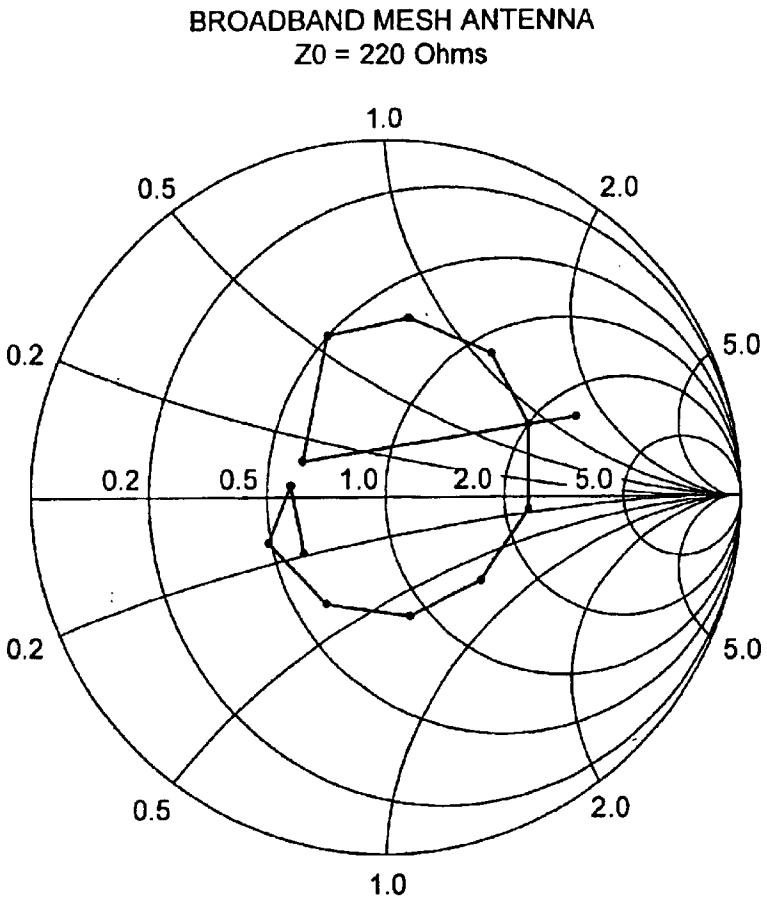
FIGS. 5*a*–5*b* illustrate Input impedance for the Ultra Broadband Mesh Antenna illustrated in FIG. 1*b*. according to an embodiment of the present invention.
Figure 5B:
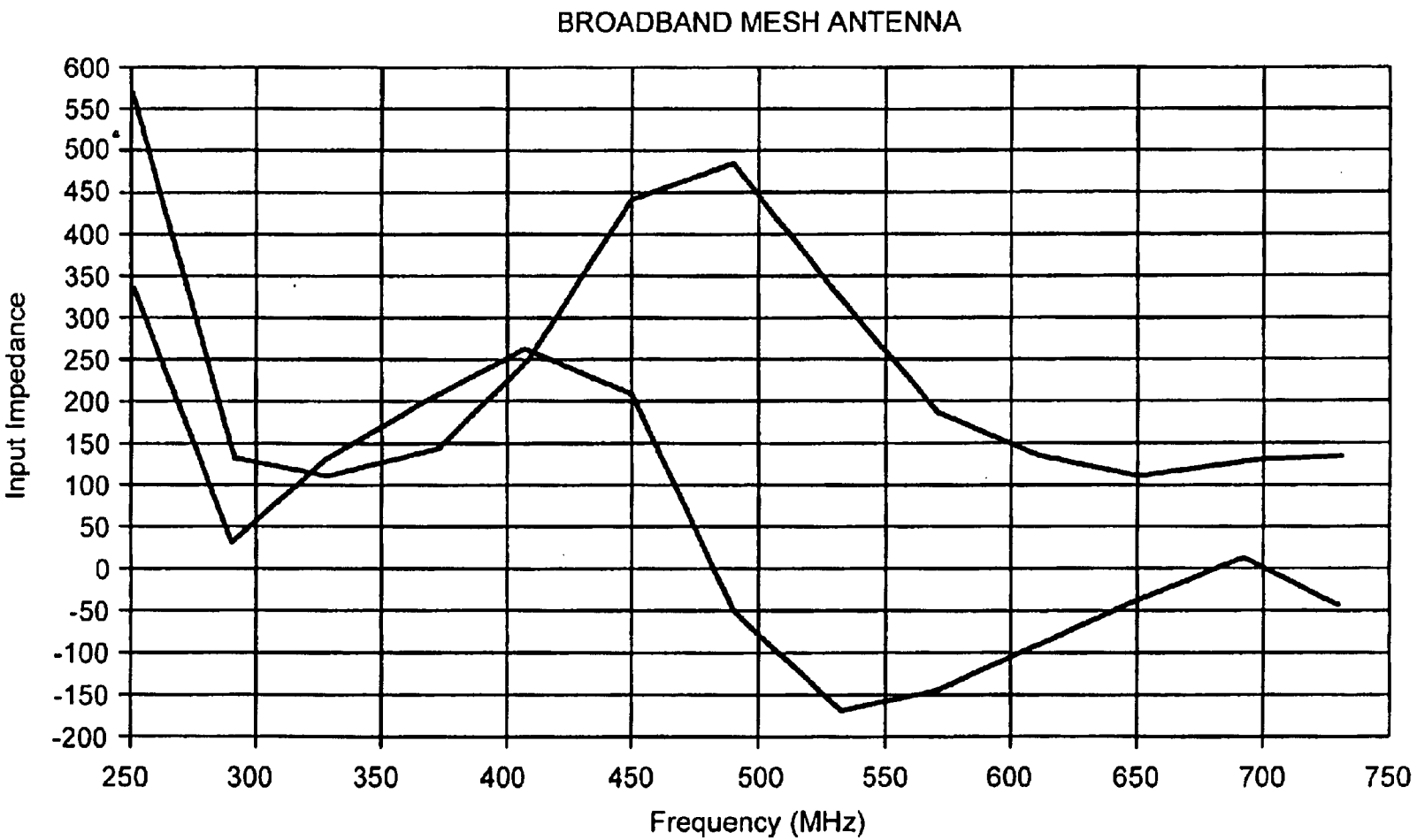

Input impedance for frequency bands from 250 MHz to 730 MHz are shown in FIGS. 5*a*–5*b* according to an embodiment of the present invention for the Ultra Broadband Mesh Antenna illustrated in FIG. 1*b*. In the graph of FIG. 5*a*, the input impedance form a well-shaped circle around the center of the Smith chart through the whole frequency band with 220 Ohms normalizing coefficient indicating compliance above 188 Ohms.

Figure 6A:
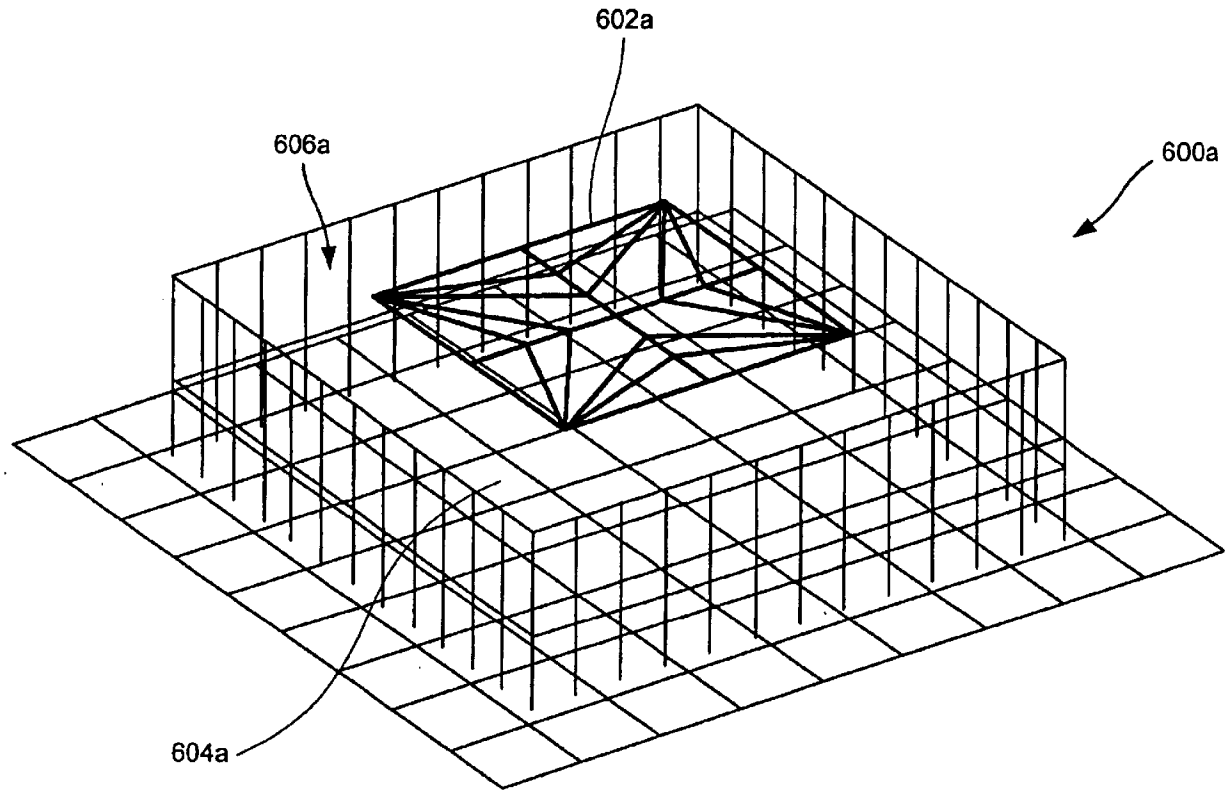
FIG. 6*a* illustrates a Ultra Broadband Mesh Antenna according to an embodiment of the present invention.
Figure 6B:
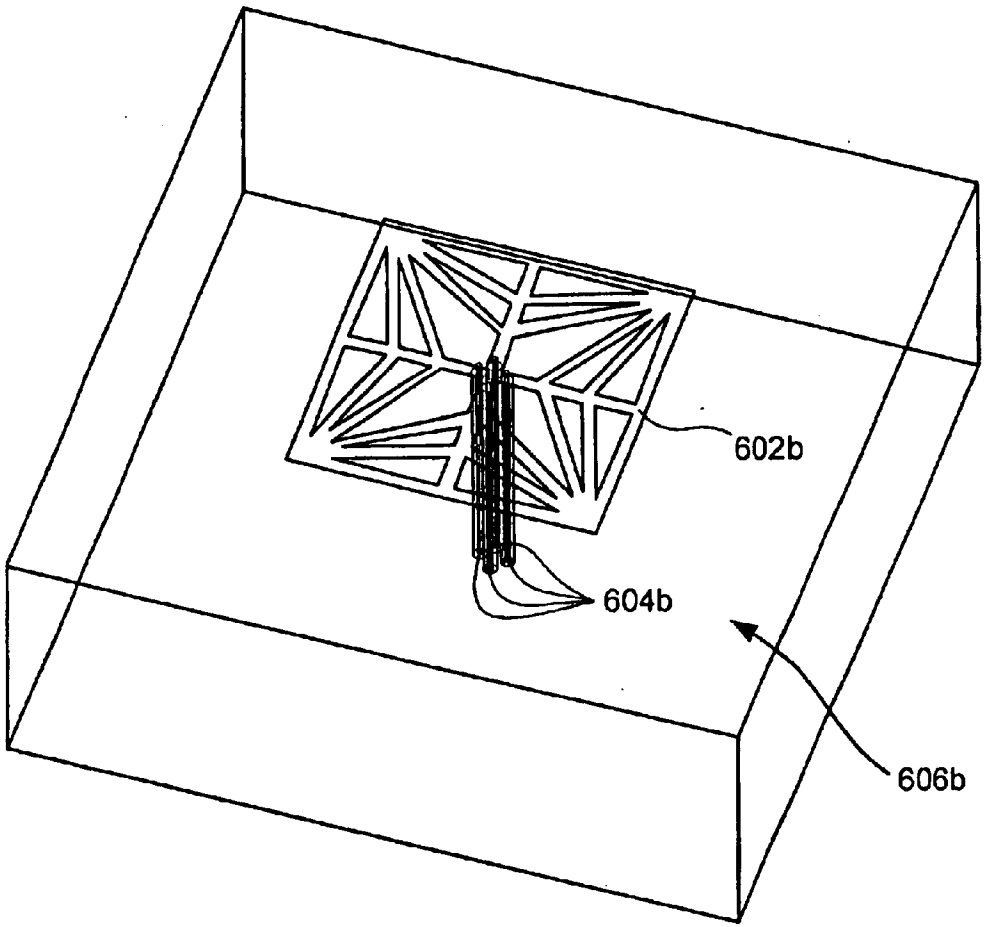
FIG. 6*b* illustrates an Ultra Broadband Mesh Antenna inside the metallic box open to the top and four coaxial lines according to an embodiment of the present invention.

Ultra Broadband Mesh Antennas, similar to the one illustrated in FIG. 1*b*, are shown in FIG. 6*a*–6*b* according to an embodiment of the present invention. In the FIG. 6*a* embodiment of the present invention for the Ultra Broadband Mesh Antenna 600*a* with box at Numerical Electromagnetic Code (NEC) is shown. The Ultra Broadband Mesh Antenna 600*a* with open top box NEC model includes an antenna element 602*a*, feed ports (not shown), feed lines (not shown) and a ground plane 604*a* inside an open top box 606*a*. In the FIG. 6*a* embodiment of the present invention, the starfish configuration of antenna element 602*a*, feed ports (not shown), feed lines (not shown), and ground screen 604*a* are formed employing wired technology. The antenna element includes feed ports which are symmetrically located around center of the antenna element 602*a* (See FIG. 1*b*). Feed lines (not shown) couple to feed ports and ground plane 604*a*. In the FIG. 6*a* embodiment of the present invention, the ground plane is the bottom of an open wire box 606*a* in which mesh antenna is placed. This Ultra Broadband Mesh Antenna may be used as a low profile high efficient broadband antenna for radar and communication systems of vehicles including, but not limited to rockets, spacecrafts, aircrafts, and ships.

In the FIG. 6*b* embodiment of the present invention an Ultra Broadband Mesh antenna is shown as a model in the Ansoft High-Frequency Structure Simulator (HFSS). Ultra Broadband Mesh Antenna 600*b* includes an antenna element 602*b*, feed ports (not shown), feed line 604*b*, and a ground plane which is the bottom of an open top metallic box 606*b*. In the FIG. 6*b* embodiment of the present invention, the starfish configuration of the antenna element 602*b* is formed employing printed circuit board technology. The antenna element 602*b* includes the feed ports which are symmetrically located around the center of the antenna element 602*b*. The feed lines 604*b* may be, but are not limited to, coaxial lines, waveguides, microstrip lines, and coplane lines. The ground plane within open top box 606*b* is made of metal such as copper, copper covered with gold or silver, aluminum, or any other material with high conductivity. This Ultra Broadband Mesh Antenna may be used, but not limited to, a low profile high efficient broadband antenna for radar and communication systems of rockets, spacecrafts, aircrafts, and ships.

Figure 7:
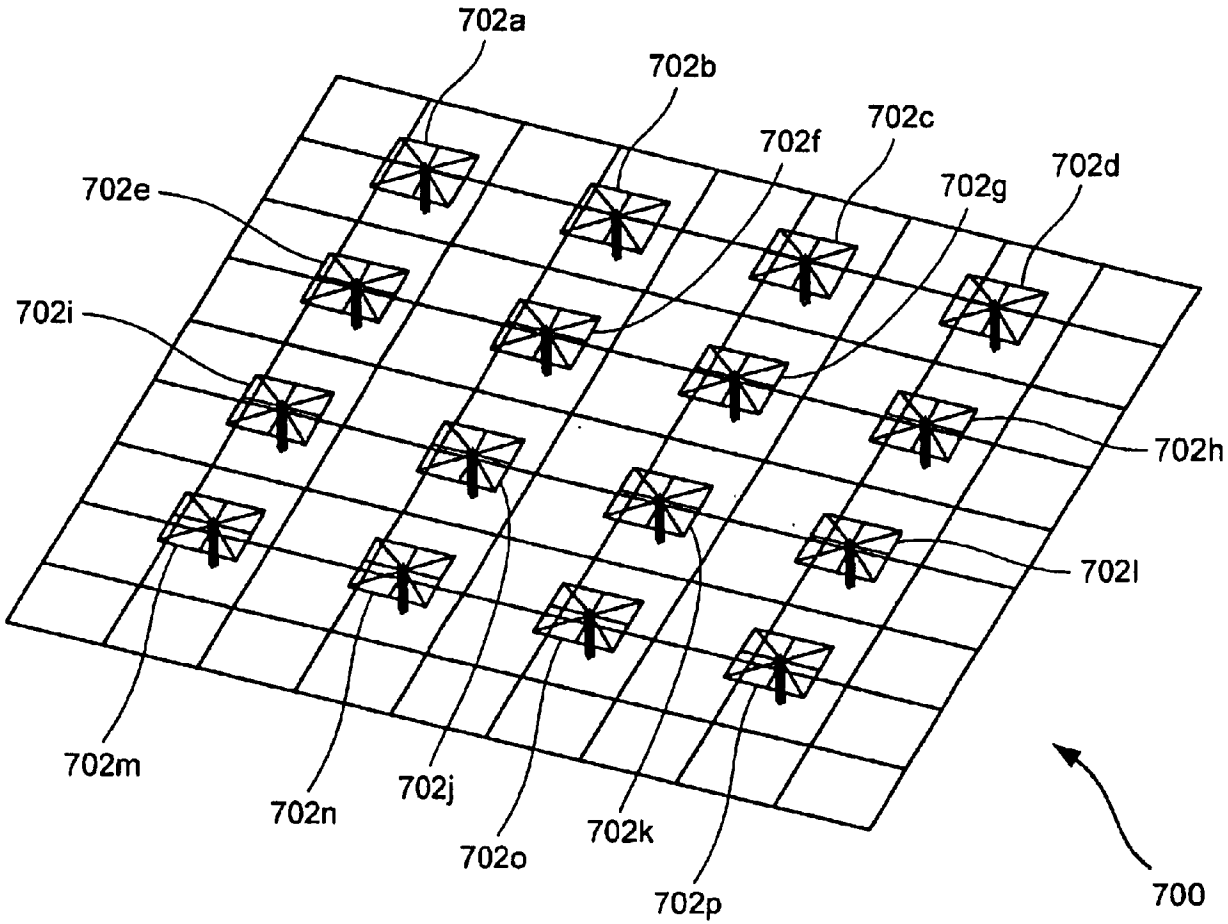
FIG. 7 illustrates a Phased Array of Ultra Broadband Mesh Antennas according to an embodiment of the present invention.

An exemplary top view of an N×N Phased Array of Ultra Broadband Mesh Antennas according to an embodiment of the present invention is shown in FIG. 7. In the FIG. 7 embodiment of the present invention, the Phased Array of Ultra Broadband Mesh Antennas 700 is an 4×4 array of Ultra Broadband Mesh Antennas. The 4×4 array of Ultra Broadband Mesh Antennas includes 16 Ultra Broadband Mesh Antennas 702*a*–702*p*. Each Broadband Mesh Antenna 702 in the 4×4 array of Ultra Broadband Mesh Antennas includes an antenna element 704 having feed ports and feed lines 706. Each Antenna element 704 may be provided with a set of starfish configurations. Each antenna element 704 may be a conductive surface including wires and printed antenna conductors. Each antenna element may be provided with symmetrically shaped configurations including a starfish and square as discussed above with respects to FIG. 2*b*. Each starfish configuration provided on an antenna element enables the broadband mesh antenna to operate at a particular octave. The feed ports of each Broadband Mesh Antenna in the 4×4 phased array of Ultra Broadband Mesh Antennas are located symmetrically around the center of the antenna element 704 of each Broadband Mesh Antenna in the 4×4 phased array of Ultra Broadband Mesh Antennas.

A set of feed lines 706 are provided for each Broadband Mesh Antenna in the 4×4 phased array of Ultra Broadband Mesh Antennas. Each set of feed lines couples to the feed ports of a respective Broadband Mesh Antenna in the 4×4 phased array of Ultra Broadband Mesh Antennas and the ground plane 708. The ground plane 708 may include a screen or bottom of an open top metallic box.

In the FIG. 7 embodiment of the present invention, the separation between each Broadband Mesh Antenna in the 4×4 phased array of Ultra Broadband Mesh Antennas is defined by a distance of 0.8 λmin where λmin is the wavelength at the highest frequency of the band. A separation of 0.8 λmin between each Broadband Mesh Antenna in the 4×4 phased array of Ultra Broadband Mesh Array Antennas provides maximum peak directivity without grating lobes and sufficient mutual coupling at the highest frequencies. Each Broadband Mesh Antenna in the 4×4 phased array or any other number of Ultra Broadband Mesh Antennas is excited in phase when in boresight operation and with linear phase distribution to steer the beam.

Figure 8A:
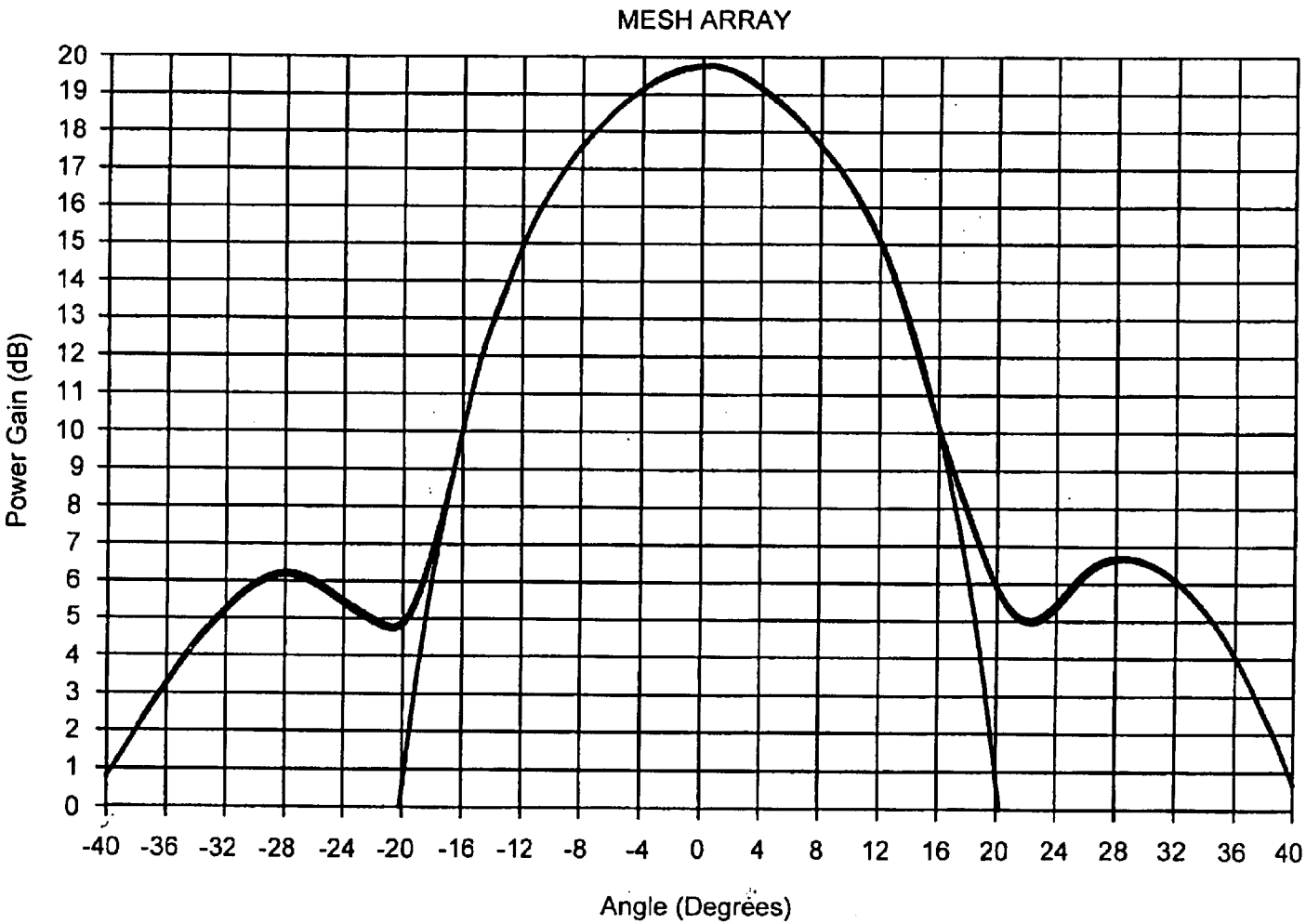
FIGS. 8*a*–8*b* illustrates Pattern Diagrams for the Array of Ultra Broadband Mesh Antennas illustrated in FIG. 7 according to an embodiment of the present invention.
Figure 8B:
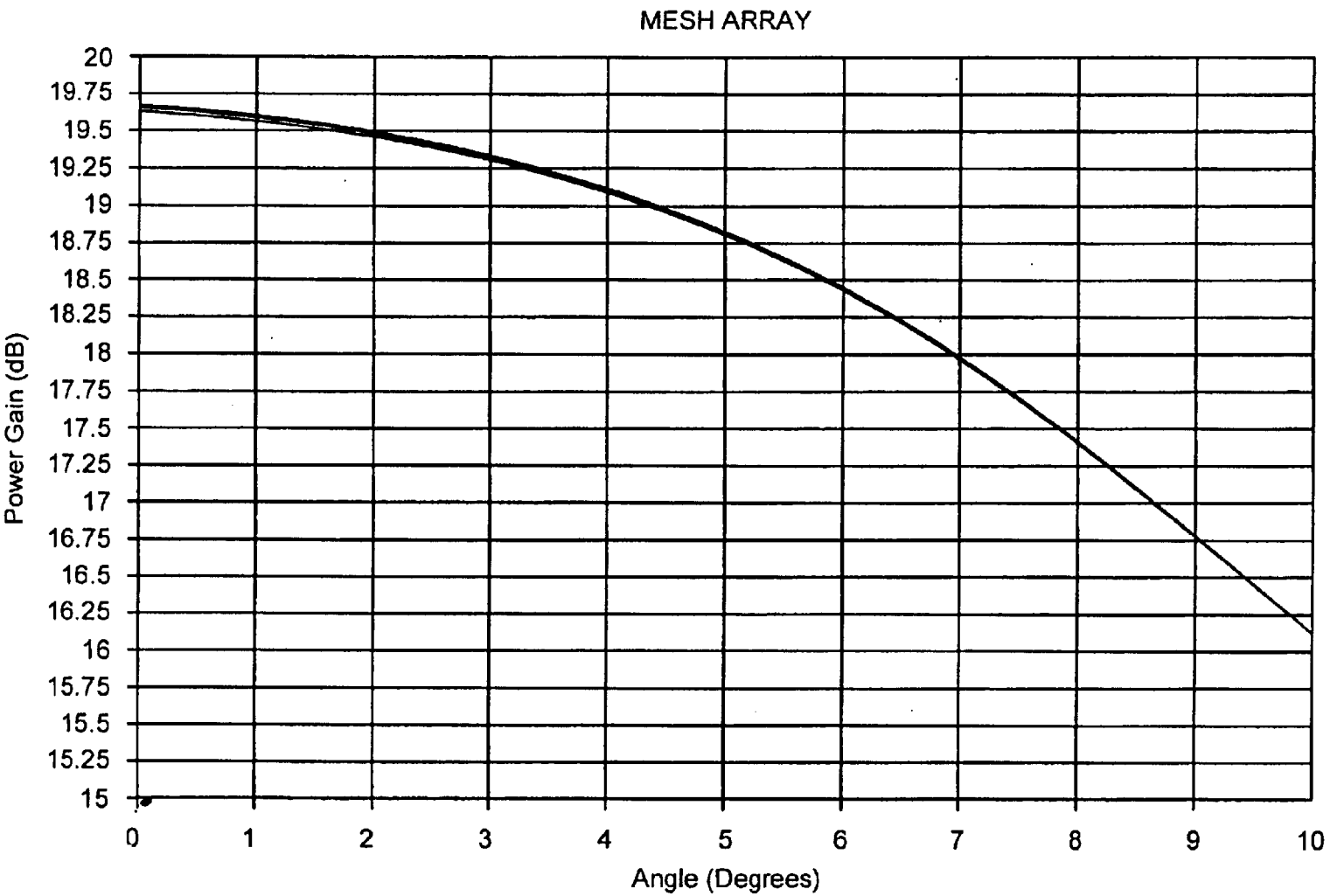

Pattern diagrams are shown in FIGS. 8*a*–8*b* according to an embodiment of the present invention for the 4×4 phased array of Ultra Broadband Mesh Antennas illustrated in FIG. 7. The expected maximum peak directivity of this array is (10*log 16+8.5) dB=20.5 dB. According to the graph of FIG. 8*a*–8*b* of the NEC simulation the peak directivity is around 19.65 dB at the 1672–1871 MHz. The difference in peak directivity can be explained by single element aperture overlapping, which decreases the mesh element effective peak directivity in a phased array environment.

Figure 9:
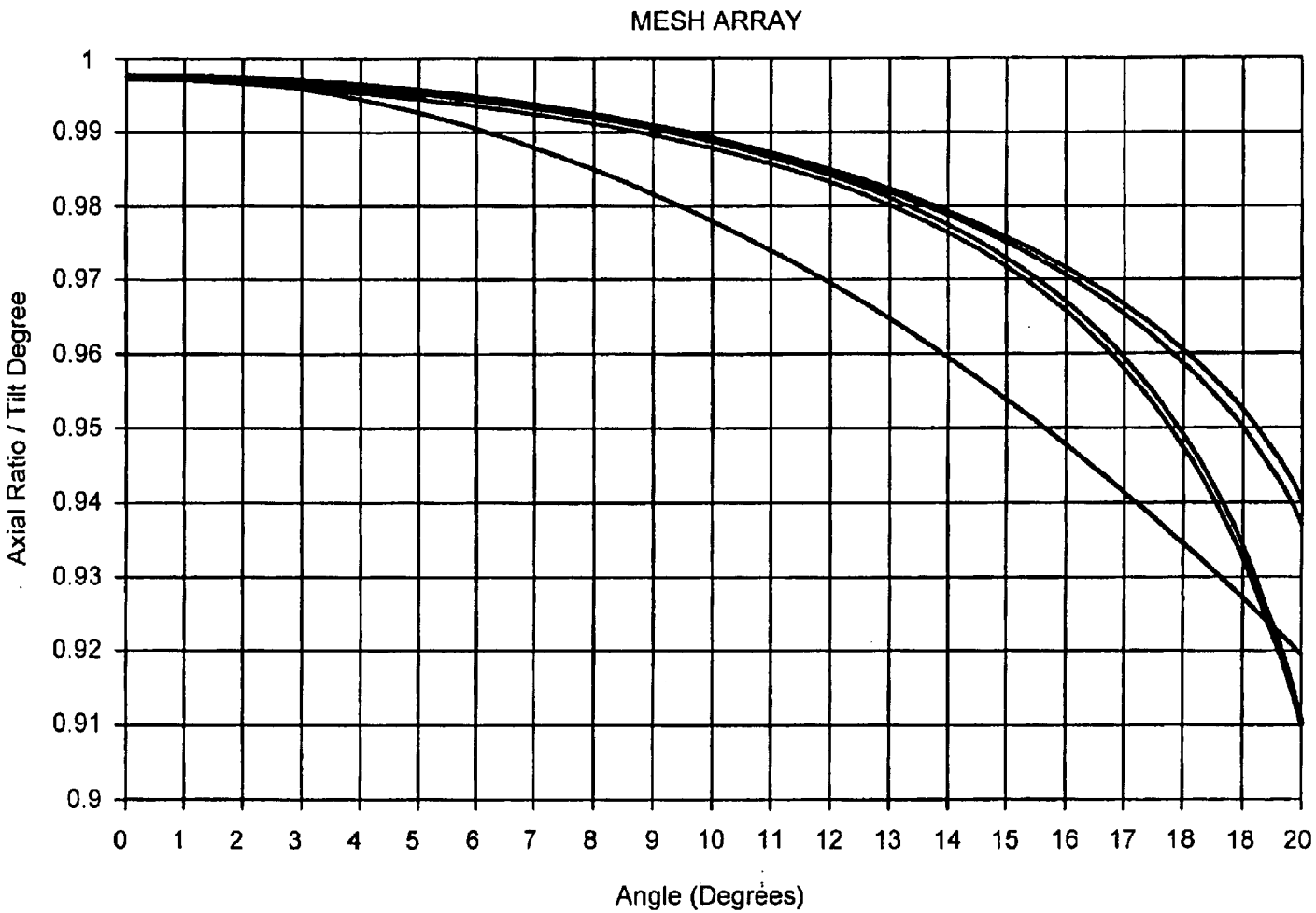
FIG. 9 illustrates Axial Ratios for the Array of Ultra Broadband Mesh Antennas illustrated in FIG. 7 according to an embodiment of the present invention.

Axial Ratios for frequency bands from 1672–1871 MHz is shown in FIG. 9 according to an embodiment of the present invention for the 4×4 array of Ultra Broadband Mesh Antennas illustrated in FIG. 7.

Figure 10:
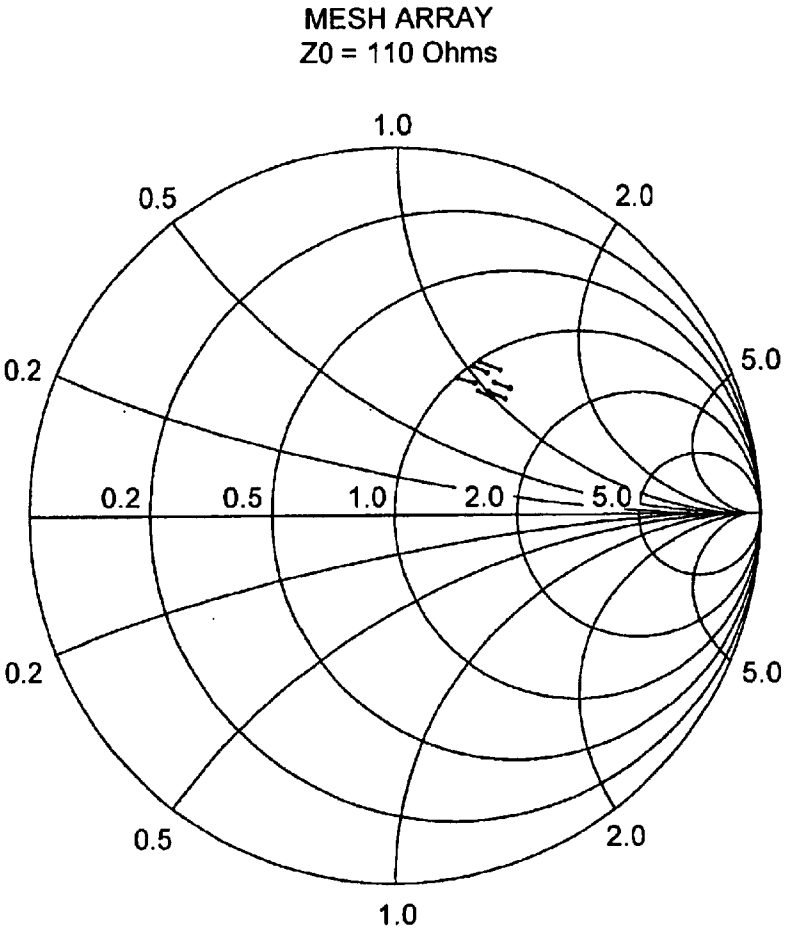
FIG. 10 illustrates Input Impedance for the Array of Ultra Broadband Mesh Antennas illustrated in FIG. 7 according to an embodiment of the present invention.

Input impedance for frequency bands from 250 MHz to 730 MHz are shown in FIG. 10 according to an embodiment of the present invention for the 4×4 array of Ultra Broadband Mesh Antennas illustrated in FIG. 7. In the graph of FIG. 10, the input impedance is approximately 110 ohms at 1672–1871 MHz. The Smith chart demonstrates the broadband antenna performance for the 4×4 array of Ultra Broadband Mesh Antennas.

While specific embodiments of the present invention have been illustrated and described, it will be understood by those having ordinary skill in the art that changes may be made to those embodiments without departing from the spirit and scope of the invention.

What is claimed is:

1. A broadband mesh antenna, comprising:

an antenna element including a conductive surface, comprising:

a symmetrically shaped conductive surface including a center point;

a set of first linear conductive surfaces extending away from the center point; and a set of second linear conductive surfaces, each of the second linear conductive surfaces extending away from one or more points on the first linear conductive surfaces;

wherein the sets of first and second linear conductive surfaces enable the broadband mesh antenna to operate at a set of octaves.

2. The broadband mesh antenna of claim 1, wherein a length S for each side of the symmetrically shaped conductive surface is proportional to at least one of wavelength and frequency.

3. The broadband mesh antenna of claim 1, wherein each of the first linear conductive surfaces are perpendicular to at least one of the other first linear conductive surfaces.

4. The broadband mesh antenna of claim 3, wherein each of the first linear conductive surfaces couples to a point corresponding to a midpoint of a side of the symmetrically shaped conductive surface.

5. The broadband mesh antenna of claim 4, wherein each of the second linear conductive surfaces couples to a point corresponding to a corner of the symmetrically shaped conductive surface.

6. The broadband mesh antenna of claim 1, wherein each of the second linear conductive surfaces couples to a point corresponding to a corner of the symmetrically shaped conductive surface.

7. The broadband mesh antenna of claim 1, wherein the set of second linear conductive surfaces enables the broadband mesh antenna to operate on a plurality of frequencies.

8. The broadband mesh antenna of claim 1, further comprising a set of feed ports coupled to the antenna element at approximately the center point.

9. The broadband mesh antenna of claim 8, further comprising a ground screen coupled to the set of feed ports.

10. The broadband mesh antenna of claim 9, wherein the ground screen is a distance H away from the antenna element.

11. The broadband mesh antenna of claim 8, further comprising an open metallic box coupled to the set of feed ports.

12. A phased broadband mesh array antenna, comprising:

a set of antenna elements, each of the antenna elements including a conductive surface comprising:

a symmetrically shaped conductive surface around a center point corresponding to the center of the symmetrically shaped conductive surface;

a set of first linear conductive surfaces extending away from the center point; and a set of second linear conductive surfaces, each of the second linear conductive surfaces extending away from one or more points on a the first linear conductive surfaces;

wherein at least the set of second linear conductive surfaces enables the phased broadband mesh array antenna to operate at a set of octaves.

13. The phased broadband mesh array antenna of claim 12, further comprising a set of feed ports coupled to each of the antenna elements at approximately the center point.

14. The phased broadband mesh array antenna of claim 13, further comprising a ground screen coupled to each set of feed ports.

15. The phased broadband mesh array antenna of claim 12, further comprising an open metallic box coupled to each set of feed ports.

16. A broadband mesh antenna, comprising:

an element including a conductive surface comprising:

a symmetrically shaped conductive surface around a center point corresponding to the center of the symmetrically shaped conductive surface;

a first starfish loop centered around the center point; and a set of linear conductive surfaces extending away from the center point.

17. The broadband mesh antenna of claim 16, wherein the first starfish loop enables the broadband mesh antenna to operate at a first set of octaves.

18. The broadband mesh antenna of claim 16, further comprising a second starfish loop centered around the center point.

19. The broadband mesh antenna of claim 18, wherein the second starfish loop circumscribes the first starfish loop.

20. The broadband mesh antenna of claim 19, wherein the first starfish loop and the second starfish loop enables the broadband mesh antenna operates at a second set of octaves.

21. The broadband mesh antenna of claim 16, further comprising a set of feed ports coupled to the antenna element approximately at the center point.

22. The broadband mesh antenna of claim 21, further comprising a ground screen couple to the set of feed ports.

23. The broadband mesh antenna of claim 22, wherein the ground screen is a distance H away from the antenna element.

24. The broadband mesh antenna of claim 21, further comprising an open metallic box coupled to the set of feed ports.

25. A phased broadband mesh array antenna, comprising:

a set of antenna elements, each of the antenna elements including a conductive surface comprising:

a symmetrically shaped conductive surface around a center point corresponding to the center of the symmetrically shaped conductive surface;

a first starfish loop centered around the center point; and a set of linear conductive surfaces extending away from the center.

26. The phased broadband mesh array antenna of claim 25, wherein the first starfish loop enables the broadband mesh antenna to operate at a first set of octaves.

27. The phased broadband mesh array antenna of claim 25, further comprising a second starfish loop centered around the center point.

28. The phased broadband mesh array antenna of claim 27, wherein the second starfish loop circumscribes the first starfish loop.

29. The phased broadband mesh array antenna of claim 28, wherein the first starfish loop and the second starfish loop enables the broadband mesh antenna to operate at a second set of octaves.

30. The phased broadband mesh array antenna of claim 25, further comprising a set of feed ports coupled to each of the elements at approximately the center point.

31. The phased broadband mesh array antenna of claim 30, further comprising a ground screen coupled to the sets of feed ports.

32. The phased broadband mesh array antenna of claim 31, wherein the ground screen is a distance H away from the antenna elements.

33. The phased broadband mesh array antenna of claim 30, further comprising an open metallic box coupled to the sets of feed ports.

34. The phased broadband mesh array antenna of claim 25, wherein the conductive surface is one of wire or etched copper.

35. The phased broadband mesh array antenna of claim 34, wherein the antenna element includes a substrate constructed from one of a strong lightweight compound, fiberglass, a honeycomb panel, or a foam core.

36. A method of creating a broadband mesh antenna including an antenna element, comprising:

configuring a symmetrically shaped conductive surface around a center point corresponding to the center of the symmetrically shaped conductive surface;

configuring a set of first linear conductive surfaces extending away from the center; and configuring a set of second linear conductive surfaces, each of the second linear conductive surfaces extending away from one or more points on the first linear conductive surfaces in the first set of linear conductive surfaces;

wherein the symmetrically shaped conductive surface, and the sets of first and second linear conductive surfaces form a conductive surface of the antenna element; and wherein at least the set of second linear conductive surfaces enables the broadband mesh antenna to operate at a set of octaves.

37. The method of claim 36, wherein a length S for each side of the symmetrically shaped conductive surface is proportional to at lease one of wavelength and frequency.

38. The method of claim 37, wherein each of the first linear conductive surfaces are perpendicular to at least one of the other first linear conductive surfaces.

39. The method of claim 38, wherein each of the first linear conductive surfaces couples to a point corresponding to a midpoint of a side of the symmetrically shaped conductive surface.

40. The method of claim 39, wherein each of the second linear conductive surfaces couples to a point corresponding to a corner of the symmetrically shaped conductive surface.

41. The method of claim 36, wherein each of the second linear conductive surfaces couples to a point corresponding to a corner of the symmetrically shaped conductive surface.

42. The method of claim 36, wherein the set of second linear conductive surfaces enables the broadband mesh antenna to operate on a plurality of frequencies.

43. The method of claim 36, further comprising coupling a set of feed ports to the antenna element at approximately the center point.

44. The method of claim 43, further comprising coupling a ground screen to the set of feed ports.

45. The method of claim 44, wherein the ground screen is a distance H away from the element.

46. The method of claim 43, further comprising coupling an open metallic box to the set of feed ports.

47. A method of creating a phased broadband mesh array antenna, including a set of antenna elements, the method comprising:

configuring each antenna element of the set of antenna elements by:

configuring a symmetrically shaped conductive surface around a center point corresponding to the center of the symmetrically shaped conductive surface;

configuring a set of first linear conductive surfaces extending away from the center point; and configuring a set of second linear conductive surfaces, each of the second linear conductive surfaces extending away from one or more points on the first linear conductive surfaces;

wherein the symmetrically shaped conductive surface, and the sets of first and second linear conductive surfaces form a conductive surface of the antenna element; and wherein at least the set of second linear conductive surfaces of each of the antenna elements enable the phased broadband mesh array antenna to operate at a set of octaves.

48. The method of claim 47, further comprising coupling a set of feed ports to each of the antenna elements at approximately the center point.

49. The method of claim 48, further comprising coupling a ground screen to each of the set of feed ports.

50. The method of claim 47, further comprising coupling an open metallic box to each of the set of feed ports.

51. A method of providing a broadband mesh antenna, including an antenna element comprising:

configuring a symmetrically shaped conductive surface around a center point corresponding to the center of the symmetrically shaped conductive surface;

configuring a first starfish loop centered around the center point; and configuring a set of linear conductive surfaces extending away from the center point:

wherein the symmetrically shaped conductive surface, the first starfish loop, and the set of linear conductive surfaces form a conductive surface of the antenna element.

52. The method of claim 51, wherein the first starfish loop enables the broadband mesh antenna to operate at a first set of octaves.

53. The method of claim 51, further comprising coupling a second starfish loop centered around the center point.

54. The method of claim 53, wherein the second starfish loop circumscribes the first starfish loop.

55. The method of claim 54, wherein the first starfish loop and the second starfish loop enable the broadband mesh antenna to operate at a second set of octaves.

56. The method of claim 51, further comprising coupling a set of feed ports to the antenna element at approximately the center point.

57. The method of claim 56, further comprising coupling a ground screen to the set of feed ports.

58. The method of claim 57, wherein the ground screen is a distance H away from the antenna element.

59. The method of claim 56, further comprising coupling an open metallic box to the set of feed ports.

60. A method of providing a phased array of broadband mesh antenna, including a set of antenna elements, the method comprising:

configuring each antenna element of the set of antenna elements by:

configuring a symmetrically shaped conductive surface around a center point corresponding to the center of the symmetrically shaped conductive surface;

configuring a first starfish loop centered around the center point; and configuring a set of linear conductive surfaces extending away from the center point;

wherein the symmetrically shaped conductive surface, the first starfish loop, and the set of linear conductive surfaces form a conductive surface of the antenna element.

61. The method of claim of 60, wherein the first starfish loop enables the broadband mesh antenna to operate at a first set of octaves.

62. The method of claim 60, further comprising a second starfish loop centered around the center point.

63. The method of claim 62, wherein the second starfish loop circumscribes the first starfish loop.

64. The method of claim 63, wherein the first starfish loop and the second starfish loop enables the broadband mesh antenna to operate at a second set of octaves.

65. The method of claim 60, further comprising coupling a set of feed ports to each of the antenna elements at approximately the center point.

66. The method of claim 65, further comprising a coupling ground screen to each of the set of feed ports.

67. The method of claim 66, wherein the ground screen is a distance H away form each of the antenna elements.

68. The method of claim 65, further comprising coupling an open metallic box to each of the set of feed ports.

69. The method of claim 60, wherein the conductive surface is one of wire or etched copper.

70. The method of claim 69, wherein each of the antenna elements includes a substrate constructed from one of a strong lightweight compound, fiberglass, honeycomb panel, or a foam core.

* * * * *

UNITED STATES PATENT AND TRADEMARK OFFICE

CERTIFICATE OF CORRECTION

PATENT NO. : 6,828,948 B2
DATED : December 7, 2004
INVENTOR(S) : Vladimir Volman et al.

It is certified that error appears in the above-identified patent and that said Letters Patent is hereby corrected as shown below:

Column 4,
Line 55, after "square." insert -- (As used in this application, the term "starfish" refers to a geometric shape having four or more legs). --.
Line 58, after "technology." insert -- The antenna element can include a substrate made of a strong lightweight compound such as Kapton or Teflon, fiberglass, a honeycomb panel or a foam core. --.

Signed and Sealed this

Eleventh Day of April, 2006

JON W. DUDAS
*Director of the United States Patent and Trademark Office*